United States Patent [19]

Greenwood

[11] 3,999,463

[45] Dec. 28, 1976

[54] FLUID MOTOR CONSTRUCTION

[75] Inventor: Martin W. Greenwood, West New York, N.J.

[73] Assignee: Componetrol, Inc., Chicago, Ill.

[22] Filed: Feb. 27, 1975

[21] Appl. No.: 553,805

[52] U.S. Cl. ..... 91/395; 91/26

[51] Int. Cl.[2] ..... F15B 15/22

[58] Field of Search ..... 91/395, 26, 394, 396; 92/85 R, 85 A, 85 B

[56] References Cited

UNITED STATES PATENTS

| | | | |
|---|---|---|---|
| 2,556,698 | 6/1951 | Loewe | 91/395 |
| 3,067,726 | 12/1962 | Williams | 91/395 |

FOREIGN PATENTS OR APPLICATIONS

| | | | |
|---|---|---|---|
| 1,175,995 | 8/1964 | Germany | 91/395 |
| 2,041,597 | 8/1971 | Germany | 91/395 |

*Primary Examiner*—Paul E. Maslousky
*Attorney, Agent, or Firm*—Pennie & Edmonds

[57] ABSTRACT

An improved spring controlled poppet-type cushion for a fluid piston-cylinder device, wherein the cushion is connected to the piston by spring means and aligned with the inlet-exhaust opening at the end of the cylinder. The improved cushion includes retaining structure for holding the spring associated with it in axial alignment with the opening for receipt therein as the piston approaches the end of the cylinder. This permits the piston to move into contact with the wall without interference from the spring. The sealing of the cushion within the opening in the end of the cylinder is effected at a point spaced axially from the piston when the latter is in contact with the end wall to provide an axial spacing between the cushion and piston.

7 Claims, 3 Drawing Figures

FLUID MOTOR CONSTRUCTION

BACKGROUND OF THE INVENTION

The present invention is generally directed to fluid motors. More particularly, it is directed to a fluid motor which permits the utilization of spring type poppet cushions without the use of conventional cylinder spacers or stop tubes at each end of the cylinder. This permits a reduction in the length of such fluid motors to the extent that they may satisfy national interchangeable standards.

Heretofore, it has been common practice in the field of fluid motors to provide a cushion effect at the ends of the piston stroke for purposes of preventing destructive impact of fluid motor components and to reduce the noise of operation of the motor. Ordinarily, such cushioning is effected by sealing off the major portion of the exhaust flow immediately prior to the termination of the piston stroke. This enables fluid pressure to build up against the exhaust side of the piston and thereby provide a decelerating effect on the piston.

One prior art fluid motor cushion arrangement employs a poppet type cushion to effect the cushioning or deceleration of the piston. Ordinarily, the poppet type cushion includes a cushion sealing element which is slidably movable on the piston rod of the fluid motor. Normally, the cushion element is spring biased in a direction away from the piston. The cushion sealing element will sealingly engage with the inlet-exhaust opening formed in the end wall of the cylinder. Once such cushion element closes the opening, it normally serves to cut off the exhaust path of the fluid therethrough. Thus, a quantity of pressurized fluid, either air or hydraulic fluid, is trapped between the piston and the cylinder end wall. During continued movement of the piston to the end of its stroke, the trapped fluid is metered from the contracting chamber by means of a metering valve. Such metering of the trapped fluid slows the rate of piston movement to thereby provide for the desired cushioning effect at the end of the piston stroke.

Although poppet-type cushion devices function quite satisfactorily, they nevertheless require the use of spacers or stop tubes internally of the cylinder so as to prevent the crushing of the spring associated therewith as the piston moves towards the end of its stroke within the cylinder. Typically, these spacers are generally cylindrical tubular members which are positioned at opposite ends of the cylinder and ordinarily serve to contact the piston as it moves toward the end wall of the fluid cylinder. By virtue of the spacers, the piston movement will be stopped at a point spaced axially from the end wall. The axial space thereby provided is sufficient to retain the structure associated with the cushion, including the compressed spring. Thus, the piston will not crush or otherwise deform the spring associated with the cushion device.

With the above construction, however, the overall length of a fluid cylinder having poppet-type cushions is necessarily longer than the overall length of a non-cushion cylinder structure having the same piston stroke. More specifically, if a non-cushion cylinder structure has a piston stroke of predetermined dimension, the length of the cylinder housing must be increased by the total length of the two spacers in order to provide a cushion cylinder with the same piston stroke. If the length of the cylinder were not increased and the spacers simply inserted into the non-cushion cylinder housing, the stroke of the piston would be decreased by the length of the spacers and would not be operatively equivalent to the non-cushion structure. In the industry, there are national standards that define the external dimensions of the cylinder and there are requirements that both the non-cushion and cushion types of cylinder be interchangeable in that they both have the same external dimensions. These standards do not permit any increase in the cylinder length. These standards can be met by cushion structures which are fixed to opposite sides of the piston; but to applicant's knowledge, there are no commercially available poppet-type cushion structures which are interchangeable with non-poppet-type cylinders.

SUMMARY OF THE INVENTION

According to the teachings of the present invention, the aforenoted shortcomings associated with fluid motors having poppet-type cushions are overcome by providing a novel and improved poppet-type cushion means which dispenses with the requirement for spacers or stop tubes and enables such motors to be manufactured in accordance with the national interchangeable standards presently applicable.

The cushion means of the present invention includes an outer peripheral sealing means for sealing against the periphery of the exhaust opening in the end of the cylinder. An inner sleeve extension is connected to and disposed radially inwardly of the sealing means and extends axially therebeyond in a direction away from the piston. Holding means is located at the forward end of the sleeve extension for holding one end of the cushion spring, the other end of which is held by the piston. The sleeve extension is axially aligned with said exhaust opening for positioning therein when said sealing means is in sealing engagement with the periphery thereof; and the spring is constructed so that its compressed length is no greater than the axial distance between the holding means and the axially aligned face of the piston when the piston is disposed in engagement with the internal face of the end of the cylinder. The above construction eliminates the need of spacers and permits the piston to have the same stroke as in a non-cushion cylinder structure.

As another features of the present invention, the sealing of the cushion within the opening at the end of the cylinder is such that the cushion acts as a check valve when the direction of fluid flow is reversed. Generally, the periphery of the exhaust opening of the cylinder against which the sealing means of the cushion seals is axially spaced from the internal face of the end of the cylinder to provide axial spacing between the cushion and piston when the piston is in engagement with the internal face. Accordingly, the cushion will blow open immediately upon reverse flow to expose the piston to full fluid flow. The result is a significant increase in the overall speed of operation of the device over conventionally cushioned cylinders employing a separate check valve.

DETAILED DSCRIPTION OF THE PREFERRED EMBODIMENT

Figure 1:
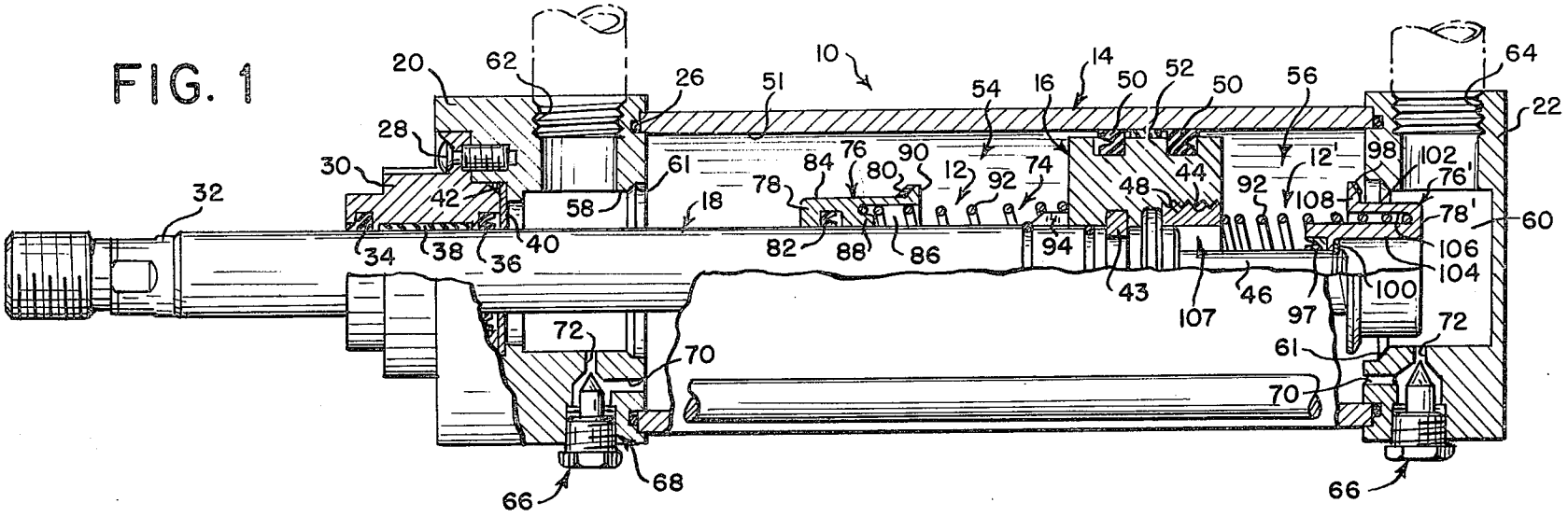
FIG. 1 is a partial cross-scetional view of a fluid motor embodying the novel and improved cushion means of the present invention.

With reference to the drawings, a conventional fluid motor 10 is shown with the improved cushion means 12 of the present invention incorporated therein. Basically, the fluid motor 10 is comprised of a fluid cylinder 14, piston 16 and piston rod 18. The fluid cylinder 14 includes a pair of opposed cylinder end wall members 20 and 22 with a generally cylindrical tubular body member 24 suitably secured and interposed therebetween. A pair of O-ring sealing elements 26 may be provided at each juncture between the cylindrical member 23 and end wall members 20 and 22 to effect fluid seals therebetween. Connected to the end wall 20, such as by threaded bolts 28, is a journal bushing 30 which serves to sealingly journal piston rod 18 for reciprocation in a forward and reverse direction. Piston rod 18 has a protruding end portion 32 projecting from the bushing 30 for connection, in a known manner, to a device (not shown) which is to be operated or moved by the fluid motor 10. Suitably received within journal bushing 30 are a pair of pressure responsive seal members 34 and 36 which engage the rod 18 so as to prevent leakage from the interior of the fluid motor 10. Intermediately disposed between the interior of the fluid motor 10. Intermediately disposed between the seal members 34 and 36 is a low friction, non-metallic bushing bearing 38 made of an appropriate material, such as an easily replaceable strip of Teflon. Annular end plate 40 is inwardly positioned with respect to bushing 30 and has its outer periphery sandwixhed between the journal bushing and end cap member 20. An O-ring sealing element 42 is placed on the outboard side of end plate 40 for preventing leakage of fluid from the interior of the cylinder body 24.

Referring now to the piston 16, it is attached to the piston rod 18 by a conventional type retaining means 43 so as to be conjointly movable therewith. Accordingly, in response to selective fluid actuation, the piston 16 is effective to move the rod 18.

On end of the piston 16 has an internally threaded recess 44. Centrally disposed within such recess 44 is a longitudinally extending cushion guide 46 which has an enlarged head abutting the forward end of the rod 18. A piston retainer nut 48 threadedly cooperates with the internally threaded recess 44 and acts to removably secure the cushion guide 46 in abutting relationship to the rod 18, as well as also serving to additionally secure piston 16 to the rod.

A pair of piston sealing members 50 are received within grooves formed in the periphery of the piston 16. The piston sealing members 50 are pressure responsive and arranged to effect a seal between the periphery of piston 16 and the interior wall surface 51 of the cylinder body 24 so as to prevent fluid leakage around the piston. Another non-metallic, low friction annular strip of bearing material 52 is interposed between piston sealing members 50 for well-known purposes.

Piston 16 is arranged to divide the interior of the cylinder body 24 into a pair of exhaustible chambers 54 and 56, each one of which is fluidly isolated from the other. As will be understood, selective admission and exhausting of pressurized fluid from chambers 54 and 56 is effective to correspondingly displace the piston 16 and thereby the piston rod 18.

Each of the cylinder end walls 20 and 22 include respective inlet-exhaust openings 58 and 60 in open communication with respective ones of the chambers 54 and 56. Chamfered seats 61 define the open end of the openings 58 and 60 and have relatively larger diemsnion that the remaining portion of the openings. Such seats 61 are situated immediately adjacent chambers 54 and 56.

At opposite ends of fluid cylinder 14 are situated typical fluid inlet-outlet ports 62 and 64. Each of such ports 62 and 64 are in open communication with openings 58 and 60, respectively, in the end walls; and through conventional connections, provide for the selective fluid admission and the establishing of fluid exhaust to chambers 54 and 56. By reason of this particular construction, admission of a pressure fluid, such as air, through port 62 will pass through opening 58 and into chamber 54. As a consequence thereof, the piston 16 and piston rod 18 move rightwardly as viewed in the drawings to the opposite end wall member 22. Simultaneously with the foregoing operation, the pressurized air will exhaust from the contracting chamber 56, out through opening 60 and therefrom through port 64.

As is customary with cushion type fluid motors 10, bleed means 66 are provided within each of the end wall members 20 and 22. Bleed means 66 may be of conventional construction and are normally comprised of a bleed valve generally indicated by reference numeral 68 and passages 70 and 72 which conduct fluid from the chambers 54 and 56 to the inlet-exhaust openings 58 and 60. Passages 70 fluidly connect the interior of the chambers 54 and 56 to the bleed valves 68, while passages 72 connect the bleed valves 68 to the openings 58 and 60. The bleed valves 68 are, of course, adjustable and serve to adjust the flow of fluid as it travels from the chambers 54 and 56 and through the openings 58 and 60, respectively. In this manner, the degree of cushioning or rate of piston 16 movement may be correspondingly adjusted to whatever requirements are deemed desirable in a given particular arrangement.

Reference is now made to the cushion means 12 embodying the principles of the present invention. In the embodiment illustrated, since the fluid motor 10 is of the double acting type, there is provided a pair of front and rear cushion means 12 and 12'. Each of the cushion means 12, 12' basically incorporates a biasing means 74, 74' and a cushion device 76, 76' operatively associated with the biasing means.

With respect to the front cushion device 76, it is essentially comprised of a generally annular elongated body member 78 having an external or outer peripheral seal member 80 and an inner front piston rod seal 82. Body member 78 is normally yieldingly biased away from piston 16 and is relatively slidable with respect to rod 18. In addition, it has a sleeve extension 84 which is radially spaced from piston rod 18 to define a recess 86. Located inwardly within the recess 86 is a notch 88 which serves as a holding or retaining means for one end of the biasing means 74. The cushion body member 78 is so sized that it will be neatly received within the opening 58, whenever the piston 16, at the end of its stroke contacts end wall member 20.

Positioned at the rear of the sleeve extension 84 is a radially raised front cushion seat 90 which accommodates the outer peripheral seal member 80. Seal member 80 is designed to sealingly engage seat 61 at the entrance to the opening 58.

Figure 2:
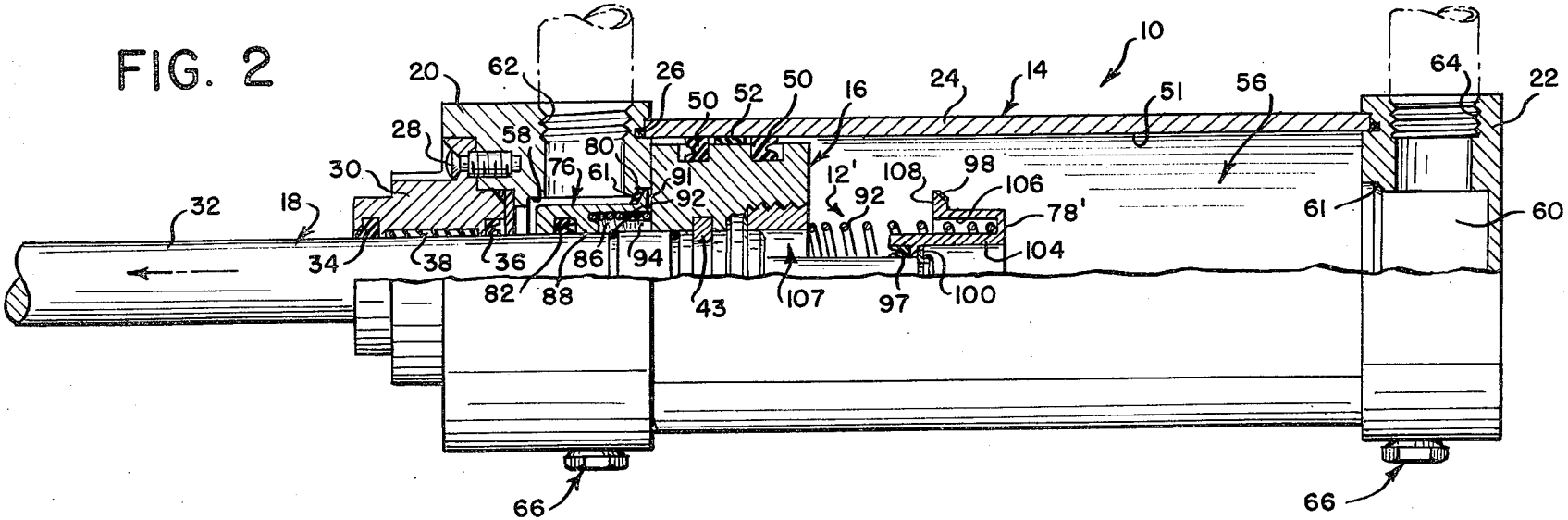
FIG. 2 is a view similar to FIG. 1, however, illustrating the novel and improved cushion means in one operative position.

As will be seen from FIG. 2, the righthand surface of the cushion seat 90 is spaced axially inwardly of the inner face of the end wall member 20. This axial spacing, denoted in FIG. 2 by reference numeral 91, permits the cushion to remain spaced from the piston when the latter is at the end of its stroke and in engagement with the inner face of the end wall 20. This construction enables the cushion to function as a check valve upon reverse movement of the piston from the position shown in FIG. 2, as more fully described below.

Biasing means 74 in the preferred embodiment includes a coil spring 92 and a spring retaining member 94. The spring retaining member 94 is attached to piston rod 18 and serves to properly retain one end of the spring 92. Coil spring 92 has its opposite end suitably received within the notch 88 and acts to yieldingly bias front cushion device 76 outwardly away from the piston.

Referring to FIG. 2, whenever the body member 78 is within the opening 58, the recess 86 will accommodate therein the compressed length of the spring 92. Consequently piston 16 is enabled to contact the internal face of the end wall member 20. As can be appreciated, the piston 16, by virtue of the aforenoted constructional arrangement, cannot crush or cause the spring 92 to otherwise fail. Moreover, the conventional spacers, normally associated with poppet-type cushions, need not be employed at opposite ends of the cylinder member 24 to protect the spring 92. It will, therefore, be appreciated that length of the cylinder body 24 may remain the same as with a non-cushion cylinder and still permit the piston to move its full stroke into engagement with the end wall.

In addition to the above, the axial spacing 91 of the cushion from the internal face of the end wall and the opposed face of the piston when the latter is in the position shown in FIG. 2 enhances the operation of the cylinder. More particularly, when fluid flow in the cylinder is reversed from that causing the piston to move to the position shown in FIG. 2, such fluid entering through the port 62 will contact the back surface of the cushion; and due to the axial spacing 91, effect movement to the right as viewed in FIG. 2. This will cause unseating and immmediately expose the piston face to full flow causing immediate movement of the piston toward the right. The cushion thus acts as a check valve and eliminates the need of separate restrictive check valve mechanisms normally required in conventional cushion designs.

Referring to the rear cushion means 12', it is essentially comprised of a generally annular body member 96, with rear cushion guide seal 97 and an outer peripheral seal 98. Such rear cushion body member 96 is adapted to be slidably movable upon and sealingly engaged with cushion guide 46. Normally, the rear cushion device 76' is biased toward the free end of the cushion guide 46. A retaining ring 100 located at the end of cushion guide 46 limits the extent of this outward movement of cushion device 76'. The rear cushion body member 96 of this particular embodiment differs slightly from the front cushion body member 78. However, it is to be noted that both perform in the same manner.

The rear cushion member 96 has a sleeve extension 102, which overlies an inner sleeve portion 104 to define a generally annular recess 106 which functions to suitably receive the biasing means 74', such as spring 92, in the manner as recess 86. The forward end of the sleeve extension 102 where it turns to connect with the portion 104 defines a holding means for the spring. Sleeve 102 is radially spaced from guide 46 and the surrounding spring 92 is aligned with and contacts retaining nut 48.

Projection 108 extends radially outwardly from the sleeve extension of the rear cushion member 78' and serves to define a rear cushion seat. Sealing member 98 is fastened to seat 108 and is adapted to engage the chamfered seat 61 so as to positively block any flow from the chamber 56 through bore 60, to thereby provide for a positive cushioning effect. Rear cushion member 78'; like the front cushion member 78, is dimensioned such that it is neatly and completely received within bore 60 whenever piston 16 contacts the end wall of end section 22. Also, as with the front cushion member 78, the seat 108 of the rear cushion member is axially spaced, as shown at 108, from the internal face of the end wall 22 when in the position shown in FIG. 3. Thus, the cushion is also axially spaced from the opposed face of the piston, permitting check valve operation of the cushion upon reverse flow.

The annular recess 106 of this rear cushion member 78' is of sufficient dimension, as measured between the holding means at the blind end of the recess and the face of the piston when the latter is in engagement with the internal face of the end wall 22, to receive the entire compacted length of the spring 92. Thus, the piston 16 may fully contact the end wall of member 22 with the spring 92 compacted in in the recess 106 and out of the way of the piston. Although the rear cushion member 78' is shaped somewhat different than the front cushion member 78, both define annular recesses large enough to adequately receive the compressed length of the springs 92.

Figure 3:
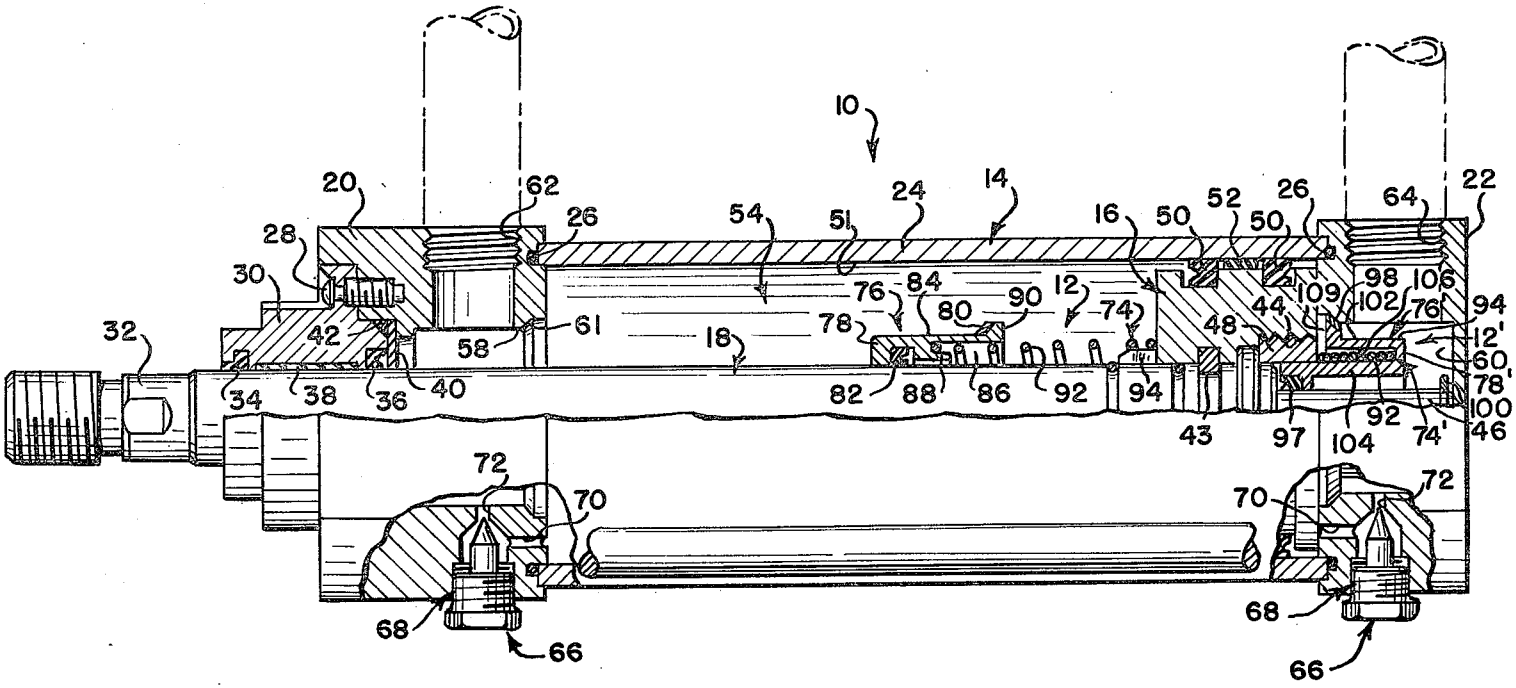
FIG. 3 is a view similar to FIGS. 1 and 2 but showing the components of the fluid motor of the present invention is another operative position.

In addition, the cushion guide seal 97 of the rear cushion is disposed axially between the piston and the outer sealing member 98. This is the reverse of the arrangement of the seals in the front cushion 76 and permits the piston to move through its full stroke to the right without necessitating an increased length in the cylinder due to the inclusion of the cushion guide rod 46. To accommodate the lefthand end of the inner sleeve portion 104, and sealing member 97, when the piston is stroked to the right of the cylinder, a radial spacing 107 between the piston and guide rod is provided. This spacing 107 permits entry of the end of the inner portion 104 into the piston structure when the latter is in engagement with the inner face of the end wall 22, as shown in FIG. 3.

Having thus described a preferred organization of components of the present invention, its mode of operation will now be described. Whenever, for example, pressurized fluid is introduced through port 62, it will enter, through opening 58, into chamber 54 to expand the same. This piston 16 will be appropriately driven rightwardly from the position indicated in FIG. 1 towards and into engagement with end wall member 22, as shown in FIG. 3. Conjointly movable with piston 16 is rear cushion means 12'. During this stroke of piston 16, rear cushion means 12' is simultaneously moved toward and eventually is received within opening 60. Owing to the size of the rear cushion body member 96, it will enter the opening 60 and continue to travel until seat 108 engages the chamfered seat 61 to form a complete fluid-tight fit. At this point, the seat 108 will also be fully received within the opening 60 to provide a slight axial spacing from the internal face of the end wall 22.

As a result of the above operation, the fluid within chamber 56, which had previously been exhausting through opening 60 to fluid port 64, is foreclosed from so doing. Gradually, since the exhaust of fluid in chamber 56 has descreased, the pressure will correspondingly increase against the right side of piston 16. This increase in pressure of the trapped fluid provides a decelerating effect on further piston movement. Since fluid in chamber 56 is no longer able to exit into the bore 60, such fluid then passes through passages 70 and 72 and bleed valve 68. Also, since the cushion device 76' is stopped from any further movement through its contact with seat 61, the piston 16 will act to compress coil spring 92 during its travel rightwardly. As the piston 16 moves further, the coil spring 92 is further compressed within recess 106 until, as clearly illustrated in FIG. 3, the spring 92 is in a completely compressed state within annular recess 106. At this point piston 16 contacts end wall 22.

The return stroke of the piston 16 toward the opposite end of fluid cylinder 14 may be easily accomplished by introducing pressurized fluid from port 64 while simultaneously enabling fluid to exhaust from chamber 54 through fluid port 62. The poppet-type cushion means 12' will under such circumstances function similarly to a check valve. Otherwise stated, cushion means 12' will immediately blow wide open, that is, unseat due to the axial spacing between the cushion and piston when the latter is at the end of its stroke and in engagement with the end wall. Accordingly, the piston 16 is immediately exposed to full pressure and lunges forward. The result of this is a significant increase in the overall speed of operation.

The operation of the front cushion means 12 will be evident from the foregoing description. Whenever front cushion body member 78 enters opening 58 and continues in such movement until sealing member 80 on seat 90 engages chamfered seat 61, fluid is no longer able to pass through the opening 58. Consequently, pressure increases in chamber 54 to provide a decelerating effect on continued movement of piston 16. The bleed means 66 allows restricted flow from chamber 54 and may be, as previously noted, adjusted to vary fluid cushion rate. As the piston 16 proceeds leftwardly toward the opposite end wall member 20, it will compress the spring 92. Owing to the compact arrangement of front cushion device 76, the spring 92 will be moved into annular recess 86. As noted earlier, the cushion device 76, with the annular recess, is also received within the opening 58. Thus, piston 16 may contact the end wall of end cap member 20.

I claim:

1. In a fluid piston-cylinder device having a housing, a poppet-type cushion means extending from the piston and biased by spring means toward an exhaust opening in one end of the cylinder, the exhaust opening having a periphery defined by the peripheral wall surface of the opening, the improvement wherein:

a. the cushion means includes an outer peripheral sealing means disposed in axial alignment with the periphery of the exhaust opening for sealing thereagainst in axially abutting relationship;

b. an inner sleeve extension connected to and disposed radially inwardly of the sealing means and extending axially therebeyond in a direction away from said piston for receiving said spring means therealong;

c. holding means at the forward end of the sleeve extension for holding one end of said spring means with the other end being held by said piston;

d. said sleeve extension is axially aligned with said exhaust opening for positioning therein when said sealing means is in sealing engagement with the periphery thereof; and e. the compressed length of said spring means is no greater than the axial distance between the holding means and the axially aligned face of the piston when the piston is disposed in engagement with the internal face of the one end of the cylinder.

2. The improvement in the fluid piston-cylinder device of claim 1 wherein:

a. the periphery of the exhaust opening of the cylinder against which the sealing means seals is axially spaced from the internal face of the one end of the cylinder to provide axial spacing between the cushion means and piston when the piston is in engagement with said internal face.

3. The improvement in the fluid piston-cylinder device of claim 2 wherein:

a. the axial length of the sleeve extension between said sealing means and holding means is at least equal to the compressed length of said spring means.

4. A fluid piston-cylinder device comprising:

a. a piston rod extending into one end of the cylinder;

b. a piston fixed to said rod for axial reciprocating movement within said cylinder between said one end and the other end thereof and into engagement with the internal faces of said ends;

c. a fluid inlet-exhaust opening in each end of the cylinder, the exhaust opening having a periphery defined by the peripheral wall surface of the opening;

d. a first cushion means slidably mounted on said rod for sealing the opening in the one end of the cylinder through which said rod extends as the piston moves toward said one end and prior to engagement of the piston with the internal face thereof, said first cushion means also being slidably mounted on said rod for axial movement relative to said piston after sealing of said opening and as said piston continues to move toward said one end;

e. a cushion guide rod extending axially from the piston and toward the other end of the cylinder;

f. a second cushion means slidably mounted on said guide rod for sealing the opening in the other end of the cylinder as the piston moves toward said other end and prior to engagement of the piston of the internal face thereof, said second cushion means also being slidably mounted on said rod for axial movement relative to said piston after sealing of said opening and as said piston continues to move toward said other end;

g. spring means connected between said piston and each of said cushion means for normally urgining them axially away from the piston; and h. each of said cushion means including:

1. an outer peripheral sealing means disposed in axial alignment with the periphery of the associated opening in the ends of the cylinder for sealing thereagainst in axial abutting relationship, 2. an inner sleeve extension connected to and disposed radially inwardly of the sealing means and extending axially therebeyond in a direction toward said opening for receiving said spring means therealong,
3. holding means at the forward end of the sleeve extension for holding one end of said spring means,
4. said sleeve extension is axially aligned with said opening for positioning therein when said sealing means is in sealing engagement with the periphery thereof, and
5. the compressed length of spring is no greater than the axial distance between the holding means and the axially aligned face of the piston when the piston is disposed in engagement with the internal face of the end of the cylinder.

5. The fluid piston-cylinder device of claim 4 wherein:

a. the periphery of each inlet-exhaust opening of the cylinder against which the sealing means seals is axially spaced from the internal face of the respective end of the cylinder to provide axial spacing between each cushion means and the piston when the piston is in engagement with said internal face.

6. The fluid piston-cylinder device of claim 5 wherein:

a. the first cushion means includes an inner peripheral sealing means for slidably sealing against the piston rod, said inner sealing means being axially spaced from the outer sealing means of the first cushion means as measured in a direction extending away from said piston;
b. the sleeve extension of the second cushion means includes a rearward portion which is disposed radially inwardly of the holding means and extends toward said piston and axially beyond the outer sealing means; and
c. the second cushion means includes an inner peripheral sealing means for slidably sealing against the guide rod, said inner sealing means being fixed to said inner portion and axially spaced from the outer sealing means of the second cushion means as measured in a direction extending toward said piston.

7. The fluid piston-cylinder device of claim 6 wherein:

a. the guide rod extends into the piston structure in radial spaced relation thereto to provide a space for receiving the inner sealing means of the second cushion means as the piston is moved into engagement with the internal face of said other end of the cylinder.

* * * * *

UNITED STATES PATENT AND TRADEMARK OFFICE

CERTIFICATE OF CORRECTION

PATENT NO. : 3,999,463

DATED : December 28, 1976

INVENTOR(S) : Martin W. Greenwood

It is certified that error appears in the above-identified patent and that said Letters Patent are hereby corrected as shown below:

Column 2, line 33, "means is" should read --means are--;
line 46, "features" should read --feature--;
line 63, "scetional" should read --sectional--.

Column 3, line 3, "is" should read --in--;
line 5, "DSCRIPTION" should read --DESCRIPTION--;
lines 29-30, delete the following: "Intermediately disposed between the interior of the fluid motor 10.";
line 36, "sandwixhed" should read --sandwiched--;
line 46, "On" should read --One--.

Column 4, line 8, "diemsnion that" should read --dimension than--.

Column 6, line 33, "in in the" should read --in the--.

Column 7, line 6, "exhausting" should read --exhausted--;
line 22, "this point" should read --this particular point--;
line 26, "from port" should read --from fluid port--.

Column 8, line 61, "urgining" should read --urging--.

Column 10, line 22, "radial spaced" should read --radially spaced--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*